US006439684B1

(12) United States Patent
Yoshimura et al.

(10) Patent No.: US 6,439,684 B1
(45) Date of Patent: Aug. 27, 2002

(54) SERIAL PRINTER ADJUSTING RECORD DISPLACEMENT CAUSED BY TRANSPORT OF RECORD SHEET, AND ADJUSTMENT METHOD THEREOF

(75) Inventors: Hisashi Yoshimura, Nara; Hajime Horinaka, Kashiba; Yuhi Akagawa, Kyoto; Kazuya Koyama, Ikoma; Yoshinobu Umetani, Yamatotakada; Norihiro Ochi, Sakurai, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/442,163

(22) Filed: Nov. 16, 1999

(30) Foreign Application Priority Data

Nov. 19, 1998 (JP) ..... 10-329193

(51) Int. Cl.[7] ..... B41J 29/393
(52) U.S. Cl. ..... 347/19
(58) Field of Search ..... 347/19, 40; 400/74

(56) References Cited

U.S. PATENT DOCUMENTS

| | | | | | |
|---|---|---|---|---|---|
| 5,862,324 | A | * | 1/1999 | Collins | 709/220 |
| 6,076,915 | A | * | 6/2000 | Gast et al. | 347/19 |
| 6,106,095 | A | * | 8/2000 | Jackson et al. | 347/19 |
| 6,109,722 | A | * | 8/2000 | Underwood et al. | 347/19 |

FOREIGN PATENT DOCUMENTS

| | | | |
|---|---|---|---|
| EP | 0 589 718 A1 | 3/1994 | 347/19 |
| EP | 0 867 298 A2 | 9/1998 | 347/19 |
| EP | 0 931 671 A2 | 7/1999 | 347/19 |
| EP | 0 978 390 A1 | 2/2000 | 347/19 |
| JP | 8-85242 | 4/1996 | |
| JP | 9-30051 | 2/1997 | |

OTHER PUBLICATIONS

Patent Abstracts of Japan, vol. 017, No. 439, Pub. No. 05096796, Pub. Date Apr. 20, 1993.

Patent Abstracts of Japan, vol. 012, No. 381, Pub No. 63132076, Pub. Date Jun. 4, 1988.

Patent Abstracts of Japan, vol. 1998, No. 01, Pub. No. 09240055, Pub. Date Sep. 16, 1997.

* cited by examiner

*Primary Examiner*—John Barlow
*Assistant Examiner*—Julian D. Huffman

(57) ABSTRACT

In a method of adjusting record displacement of a serial printer including a recording head which records a plurality of lines at a time in the main scanning direction, a first test pattern which is formed of a plurality of line patterns spaced apart by a prescribed distance is recorded in the main scanning direction, the record sheet is fed by a prescribed amount, and a second test pattern which is formed of prescribed recording patterns is recorded. Based on the positional relations between the first and second test patterns, the feeding amount of the record sheet is adjusted. Since the feeding amount of the record sheet is adjusted based on the positional relations between the first and second test patterns, record displacement in the feeding direction of the record sheet can be adjusted easily, and the cost increase of the serial printer can be suppressed.

9 Claims, 8 Drawing Sheets

SERIAL PRINTER ADJUSTING RECORD DISPLACEMENT CAUSED BY TRANSPORT OF RECORD SHEET, AND ADJUSTMENT METHOD THEREOF

BACKGROUND OF THE INVENTION

1. Field of the Invention

The present invention relates to serial printers which carry out recording by moving a recording head, capable of simultaneously recording a plurality of lines by one movement, in the direction perpendicular to the direction of feeding a record sheet. More particularly, the present invention relates to a serial printer which adjusts record displacement between a recorded row and the next recorded row caused by the movement of the recording head, as well as the adjustment method.

2. Description of the Background Art

A serial printer moves the recording head in the direction perpendicular to the direction of feeding a record sheet, for example, and records one line or a plurality of lines at the same time on the record sheet by the movement. For recording the next line or lines, the record sheet is fed by an amount which corresponds to the recorded line or lines. By repeating the operation, one page of the entire record sheet is recorded which is formed by linking a recorded line to the next recorded line.

For example, the serial printer is a high speed ink jet printer which carries out recording by using a multi-channel head. The ink jet printer emits ink according to image data, fixes the emitted ink particles (droplets) onto a record sheet, and records a reproduced image according to an ink color. In the multi-channel head, a plurality of nozzles which emit ink during one movement are provided in the same direction as the direction of feeding a record sheet. By moving the multi-channel head in the direction perpendicular to the direction of feeding a record sheet, such a number of lines that corresponds to the number of nozzles are simultaneously recorded.

After the multi-channel head is once moved, therefore, the record sheet is fed by an amount which corresponds to the number of line or lines recorded by the multi-channel head. After the record sheet is stopped, the multi-channel head moves again. The operation is repeatedly performed. The feeding, that is, transporting of the record sheet, is carried out while the sheet is held between rollers, for example.

When transporting rollers, for transporting a record sheet, with diameters of 12.00 mm and 12.01 mm are used, recording at a recording density (resolution) of 600 dpi by a multi-channel head with 960 nozzles results in a difference, that is, an error of 1.5 dots between the transport amount of sheets by the transporting rollers with different diameters. Especially for an ink jet printer and the like, it is very difficult to precisely form the transporting rollers or the like, for transporting a record sheet, to have a determined diameter. Therefore, when the transporting rollers or the like are replaced and the replaced transporting rollers are driven at a predetermined transport amount, the above described slight difference in diameter substantially changes the feeding amount and causes record displacement.

FIGS. 1A to 1C are views illustrating recorded states when a multi-channel head carries out recording by moving twice. If the transport amount of a record sheet is larger than a predetermined amount, a white line appears between a previous recorded line and the next recorded line as illustrated in FIG. 1A. If the transport amount of a record sheet is smaller, lines which are recorded by moving the recording head twice are partly overlapped, which results in a thick line as illustrated in FIG. 1B. If recording is carried out at a normal transport amount, a normal record is obtained without any white line or overlapped portion between the record given by the first movement and the record given by the next movement.

As the method of preventing a record failure due to a difference in the transport amount of a record sheet as described above, and especially as the method of adjusting a difference in the transport amount of a record sheet, a technique described, for example, in Japanese Patent Laying-Open No. 8-85242 was proposed. According to the technique, the transport amount of a record sheet is determined by recording a standard pattern on a record sheet, reading the recording result using an image sensor, comparing the read data and the table of the transport amounts of a record sheet which is preset in the apparatus, and calculating an optimum transport amount. Based on the calculation result, the feeding of a record sheet is controlled for subsequent recording.

According the technique described in the above official gazette, if the result which is recorded, for example, by moving the head multiple times is as illustrated in one of FIGS. 1A to 1C, the result is read by an image sensor to determine which state applies to the result. When the recording result illustrated in FIG. 1A, for example, is read by the image sensor, the feeding amount of the record sheet is determined to be excessive, and it is adjusted to be smaller.

According to the technique described in the above official gazette, a standard pattern is actually recorded on a record sheet, the recording result is read by an image sensor, and thus it is recognized easily which state of FIGS. 1A to 1C applies to the actual recorded state. The transport amount of a record sheet can be controlled according to the recognition result. Therefore, it can be controlled so as to record and reproduce the recorded state as illustrated in FIG. 1C.

In this case, it is necessary to provide a multi-head in the serial printer and separately provide an image sensor in the carriage for moving the multi-head. Therefore, the structure for adjusting the transport amount of a record sheet is complicated, and the cost of the serial printer is substantially increased.

Since a light source or the like for illuminating a record sheet is provided together with the above described image sensor in the carriage, the drive load for moving the carriage increases, which results in increase in the burden of a drive motor. Thus, a drive motor which has larger drive torque or the like is required, which leads to the cost increase. Further, a large number of wires such as a wire for the image sensor, a wire for the light source and so on are necessary. The structure for moving and driving the carriage is very complicated.

In adjusting the record displacement described in the above official gazette, only displacement which is caused by the feeding amount of a record sheet can be adjusted, and record displacement in the main scanning direction which is caused by the recording timing of a recording head cannot be addressed.

SUMMARY OF THE INVENTION

An object of the present invention is to provide a method of adjusting record displacement of a serial printer which can easily adjust record displacement in the feeding direction of a record sheet and can suppress the cost increase.

Another object of the present invention is to provide a method of adjusting record displacement of a serial printer which can easily adjust record displacement in the main scanning direction of a record sheet and can suppress the cost increase.

Still another object of the present invention is to provide a serial printer which can easily adjust record displacement in the feeding direction of a record sheet and can suppress the cost increase.

Yet another object of the present invention is to provide a serial printer which can easily adjust record displacement in the main scanning direction of a record sheet and can suppress the cost increase.

According to one aspect of the present invention, a method of adjusting record displacement of a serial printer recording a plurality of lines at a time in the main scanning direction includes the steps of recording, in the main scanning direction, a first test pattern formed of a plurality of line patterns spaced apart by a prescribed distance, feeding a record sheet by a prescribed amount, recording a second test pattern formed of prescribed recording patterns, and adjusting the feeding amount of the record sheet based on the positional relations between the first test pattern and the second test pattern.

Since the feeding amount of the record sheet is adjusted based on the positional relations between the first and second test patterns, record displacement in the feeding direction of the record sheet can be adjusted easily, and the cost increase of the serial printer can be suppressed.

According to another aspect of the present invention, a method of adjusting record displacement of a serial printer recording a plurality of lines at a time in the main scanning direction includes the steps of recording, in the feeding direction, a first test pattern formed of a plurality of line patterns spaced apart by a prescribed distance, recording, in the feeding direction, a second test pattern formed of prescribed recording patterns, and adjusting the ink emission timing of a recording head based on the positional relations between the first test pattern and the second test pattern.

Since the ink emission timing of the recording head is adjusted based on the positional relations between the first and second test patterns, record displacement in the main scanning direction of a record sheet can be adjusted easily, and the cost increase of the serial printer can be suppressed.

According to still another aspect of the present invention, a serial printer includes a recording head recording a plurality of lines at a time in the main scanning direction, a first drive unit driving the recording head, a second drive unit transporting a record sheet, a first control unit controlling the first drive unit to cause the recording head to record, in the main scanning direction, a first test pattern formed of a plurality of line patterns spaced apart by a prescribed distance, controlling the second drive unit to feed the record sheet by a prescribed amount, and controlling the first drive unit to cause the recording head to record a second test pattern formed of prescribed recording patterns, and a second control unit controlling the second drive unit to transport the record sheet by a feeding amount determined based on the positional relations between the first test pattern and the second test pattern.

Since the second control unit controls the second drive unit to transport the record sheet by the feeding amount determined based on the positional relations between the first and second test patterns, record displacement in the feeding direction of the record sheet can be adjusted easily, and the cost increase of the serial printer can be suppressed.

According to yet another aspect of the present invention, a serial printer includes a recording head recording a plurality of lines at a time in the main scanning direction, a first drive unit driving the recording head, a second drive unit transporting a record sheet, a first control unit controlling the first drive unit and the second drive unit to cause the recording head to record, in the feeding direction, a first test pattern formed of a plurality of line patterns spaced apart by a prescribed distance, and a second control unit controlling the first drive unit to carry out recording on the record sheet at ink emission timing determined based on the positional relations between the first test pattern and the second test pattern.

Since the second control unit controls the first drive unit to carry out recording on the record sheet at the ink emission timing determined based on the positional relations between the first and second test patterns, record displacement in the main scanning direction of the record sheet can be adjusted easily, and the cost increase of the serial printer can be suppressed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An adjustment method of easily recognizing record displacement using an easy procedure, removing the displacement, and enabling good recording in a serial printer according to the present invention will be described in the following with reference to the drawings.

Although an ink jet printer will be described as an example in the present invention, the present invention is not limited to the ink jet printer. Of course, the present invention can be utilized for all printers which include a recording head for simultaneously recording a plurality of lines by one movement, such as thermal printers and wire dot printers.

First, the operation of an ink jet printer as an example of a serial printer according to the present invention will be described with reference to FIG. 2.

Figure 2:
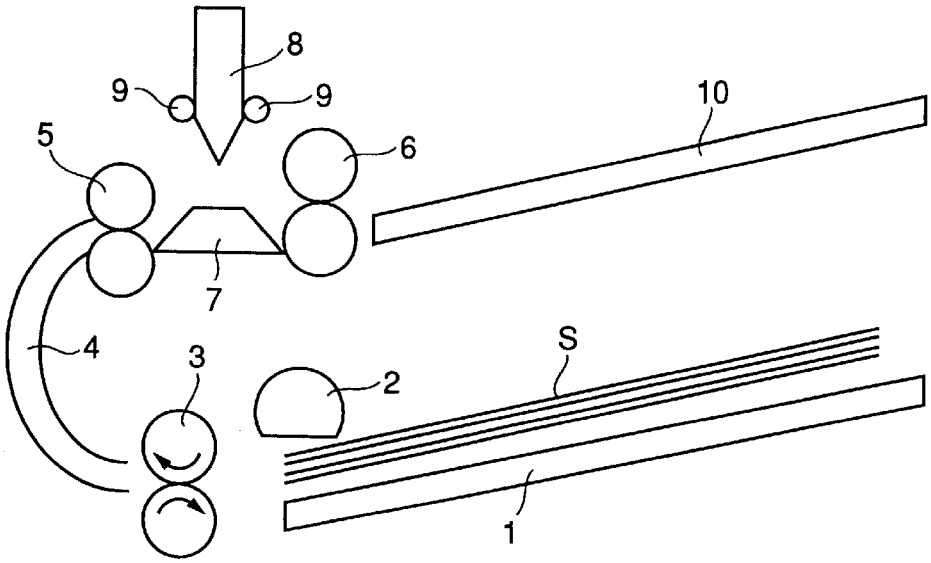
FIG. 2 is a view illustrating a schematic structure of an ink jet printer as an example of a serial printer according to the present invention.

In FIG. 2, record sheets S are placed on a feeding tray 1 and fed one by one using a half-moon shaped feeding roller 2 which is arranged correspondingly to the feeding end portion of feeding tray 1. Feeding roller 2 is driven to make one rotation so as feed a record sheet. Its chord portion faces feeding tray 1, and its arc portion feeds record sheet S by utilizing the rotation of feeding roller 2.

In front of feeding tray 1 in the feeding direction, transporting rollers 3 are provided for transporting record sheet S to a desired position. Transporting rollers 3 are formed of separate rollers of an upper roller which is driven to rotate in the direction of feeding record sheet S and a lower roller which is driven to rotate in the direction of returning record sheet S to feeding tray 1. Therefore, one record sheet S can be fed by transporting rollers 3.

Record sheet S is guided to a recording position, where the recording head according to the present invention is located, by being fed through transporting rollers 3. Along the way, record sheet S passes through a reversing path 4 and transporting rollers 5. Transporting rollers 5, which are formed, for example, of a lower driving roller and an upper idler roller, transport record sheet S at a constant speed. On the downstream side of transporting rollers 5 in the transporting direction of record sheet S, discharging rollers 6 are provided.

The recording position is located between transporting rollers 5 and discharging rollers 6. At the recording position, a platen 7 is provided for supporting the back surface of record sheet S. A recording head 8 which emits ink droplets according to image data is provided to face platen 7. Recording head 8 includes multiple emitting nozzles (emitting openings/orifices) which are arranged in the feeding direction of record sheet S, for example, and recording head 8 is reciprocated (moved back and forth) in the direction perpendicular to the direction of nozzle arrangement. Therefore, recording head 8 is provided on a carriage or the like, not shown. The carriage is formed to run along two parallel slide shafts 9 which are provided in the direction perpendicular to the feeding direction of record sheet S.

When a reproduced image corresponding to image data is formed on record sheet S, record sheet S is discharged onto a discharging tray 10 which is projectingly provided outside the printer.

Record sheet S is fed by one rotation of feeding roller 2 and sent to transporting rollers 5 through transporting rollers 3. Transporting rollers 5 once stop record sheet S, which is fed, align the top end of record sheet S at the nip portion of transporting rollers 5, and then start transporting record sheet S when recording head 8 becomes recordable. After record sheet S is transported through transporting rollers 5 by a determined amount, recording head 8 moves (forth) in the recording direction from its home position to simultaneously record a plurality of lines. After recording, record sheet S is transported through transporting rollers 5 by an amount which corresponds to the number of recorded lines during one movement, and then recording sheet S is stopped. In the meantime, recording head 8 moves (back) to the original movement starting position (home position), makes the next movement for stopped record sheet S, and records the next lines.

As described above, by transporting record sheet S by a determined amount and sequentially repeating the movement of recording head 8, one page of an image which corresponds to image data is reproduced and recorded on record sheet S. When one page of an image is reproduced and recorded, record sheet S is discharged onto discharging tray 10 through discharging rollers 6. Reproducing and recording on record sheet S are carried out in this manner.

Figure 1A:
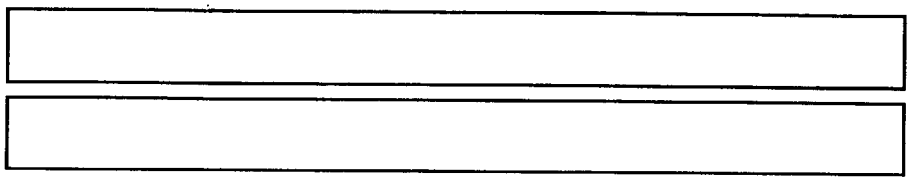
FIG. 1A PRIOR ART
FIG. 1A is a view illustrating a white-line state with a larger feeding amount.
Figure 1B:
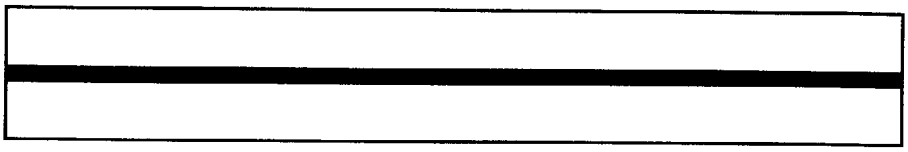
FIG. 1B PRIOR ART
FIG. 1B is a view illustrating a black line recorded state with a smaller feeding amount.

In the recording operation, if linkage between a certain recorded line and the next recorded line, which are recorded by moving recording head 8 multiple times, is not normal, the recording result as shown in FIG. 1A or 1B is obtained. Although this is adjusted by feeding record sheet S by a predetermined amount, the feeding amount is subtly changed when there is a difference in the materials of record sheet S, the thickness of record sheet S, and so on. The change is also caused when the diameter of transporting rollers is changed after replacement of transporting rollers 5, when the slip amount is changed with the passage of time, and so on.

An adjustment method of the present invention concerning the control of feeding of record sheet S to solve the problems will be described in detail below.

First Embodiment

Figure 3A:
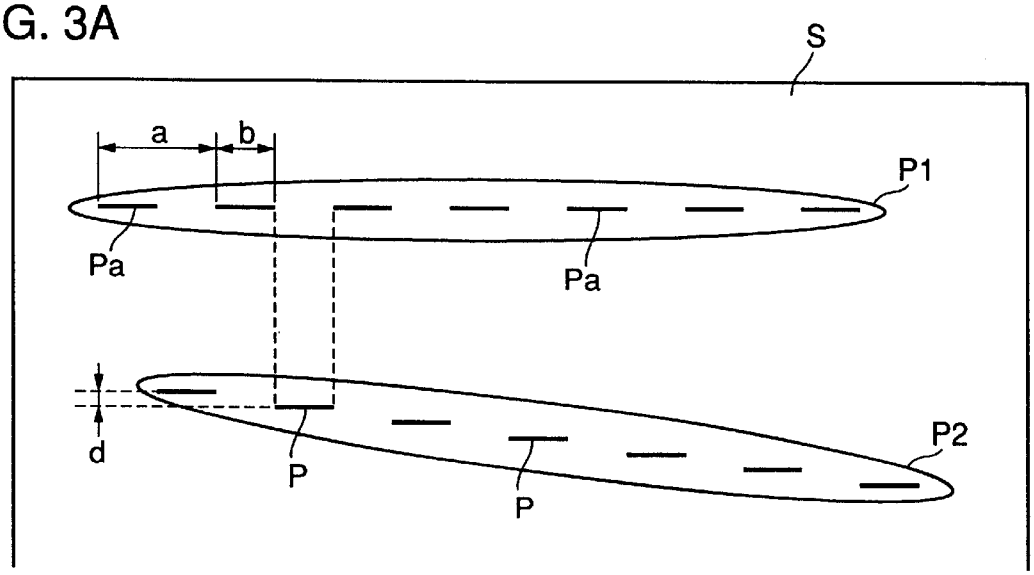
FIGS. 3A and 3B are views for describing the principle of an adjustment method according to a first embodiment of the present invention, illustrating an example of first and second test patterns for adjusting record displacement which is caused by deviation in the feeding amount of a record sheet by the serial printer according to the present invention.

In the present invention, a predetermined test pattern is recorded on record sheet S to adjust and control the feeding amount of record sheet S. The test pattern includes a first test pattern P1 and a second test pattern P2 as illustrated in FIG. 3A. By recording them on the same record sheet S and overlapping the test patterns on record sheet S, record displacement is made easily recognizable.

After first test pattern P1 is first recorded, record sheet S is transported by a determined amount (length) to record second test pattern P2. One example of the recording result is illustrated in FIG. 3B.

In a first embodiment of the present invention, first test pattern P1 illustrated in FIG. 3A is formed of a plurality of line patterns which are recorded for every constant distance (pitch) a to have a prescribed width (length) b in the main scanning direction. First test pattern P1 is recorded using a specific recording nozzle Na of recording head 8 illustrated in FIG. 4. Therefore, the first pattern is recorded by controlling recording head 8 to emit ink at prescribed timing while causing recording head 8 to move to the right of record sheet S. For distance (pitch) a, width b is such that a=2b. They are not limited to the relationship, and the distance or the width may be larger to some extent.

Figure 4:
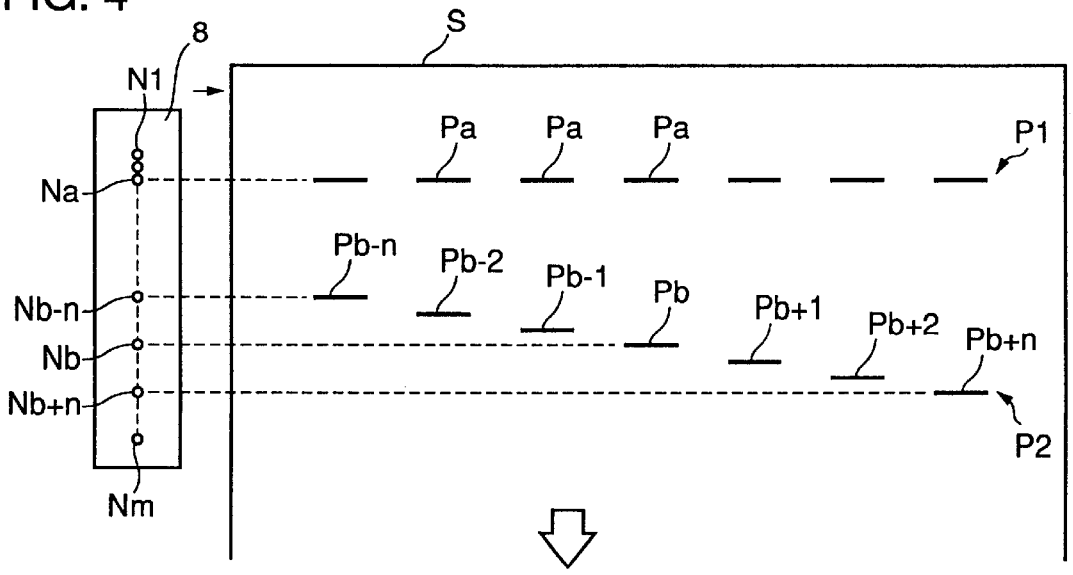
FIG. 4 is a view for describing an example of the case where the first and second test patterns illustrated in FIG. 3A are recorded by the recording head of an actual serial printer.

Second test pattern P2 is formed of recording patterns P at the same pitch a and width b as line patterns Pa of first test pattern P1. For recording patterns P, each recording pattern is recorded to be offset from the preceding recording pattern by the distance of one dot in the record sheet transporting direction. In order to record second test pattern P2, a plurality of nozzles Nb−n to Nb+n are utilized which are, as illustrated in FIG. 4, provided backward and forward a recording nozzle Nb which is spaced apart from specific nozzle Na of recording head 8 by a prescribed number (at least two) of nozzles. Each recording pattern P of second test pattern P2 is recorded by moving recording head 8 in the main scanning direction so as to be recorded between line patterns Pa of first test pattern P1.

Figure 3B:
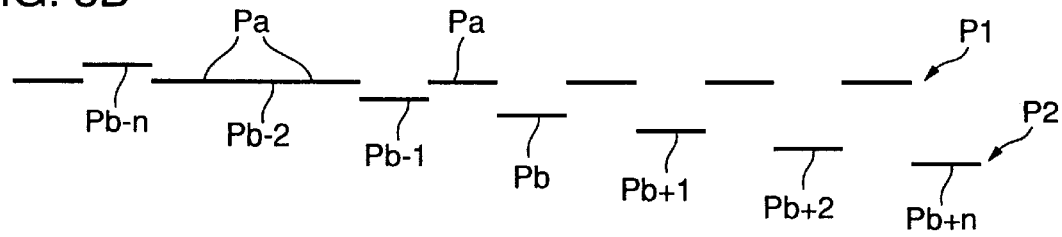

As illustrated in FIG. 3B, in second test pattern P2, each recording pattern Pb−n to Pb+n is recorded to be offset from the preceding pattern in the record sheet feeding direction. The nozzles of recording head 8 which are utilized to form second test pattern P2 are seven successive nozzles which include the three nozzles of recording nozzle Nb and the ones backward and forward recording nozzle Nb as illustrated in FIG. 4. In second test pattern P2, a recording pattern Pb is set as a base pattern. The recording patterns are recorded to be offset from their preceding patterns by one dot with base pattern Pb being the center.

In the present invention, first test pattern P1 is first formed by feeding record sheet S through transporting rollers 5 until record sheet S is stopped when record sheet S becomes recordable. For record sheet S which is stopped in this state, recording head 8 is moved in the direction of arrow, as illustrate in FIG. 4, and, according to the position of moved recording head 8, that is, the position of the carriage, ink is emitted from nozzle Na of recording head 8. Thus, first test pattern P1 as illustrated in FIG. 3A is recorded.

After first test pattern P1 is recorded, recording head 8 is returned to the home position and, in the meantime, record sheet S is transported by a prescribed amount and then stopped. The prescribed amount is a length which corresponds to the number of dots, that is, the number of nozzles from recording nozzle Na to recording nozzle Nb of recording head 8. When the interval of dots is 100 $\mu$m (the dot diameter is simply made 100 $\mu$m), and the number of dots from recording nozzle Na to recording nozzle Nb is 50, record sheet S is fed by 5 mm.

When feeding is completed, recording head 8 which has returned to the home position is moved again in the direction of arrow. In order to record second test pattern P2, recording nozzles Nb−n to Nb+n are used to sequentially record recording patterns Pb−n to Pb+n.

As illustrated in FIG. 3B, recording patterns Pb−n to Pb+n of second test pattern P2 are recorded to be placed between line patterns Pa of first test pattern P1. According to the recording result illustrated in FIG. 3B, pattern Pb−2 in second test pattern P2, that is, the recording pattern placed two patterns before base pattern Pb is recorded to overlap a space between line patterns Pa of first test pattern P1.

If record sheet S is fed by a prescribed amount and the feeding amount is correct without deviation, base pattern Pb should be recorded to lie between line patterns Pa of first test pattern P1 in a successive manner. If the recording result of the test patterns as illustrated in FIG. 3B is obtained, there is deviation in the feeding amount (feeding delay) of record sheet S which corresponds to two dots. The recording result illustrated in FIG. 1B is thus obtained.

When the feeding amount by transporting rollers 5 is the total number of nozzles of recording head 8, that is, a distance corresponding to 100 nozzles, for example, and the number of nozzles from base nozzle Na to central nozzle Nb is 50, the displacement amount after one movement for transporting record sheet S is that of at least four dots as a whole. When transporting rollers 5 are driven by a stepping motor, for example, and the feeding of record sheet S which corresponds to one dot is carried out in two steps, feeding adjustment to add at least eight steps is necessary to eliminate the displacement of at least four dots. To put it more precisely, the operation in step S7 of the flow chart in FIG. 7 may be carried out.

If first test pattern P1 is recorded as illustrated in FIG. 3A, record sheet S is transported by a prescribed amount, second test pattern P2 is recorded, and, as a result, one of recording patterns Pb−1 to Pb+n on the right side of base pattern Pb overlaps line patterns Pa of first test pattern P1, record sheet S has been excessively fed as illustrated in FIG. 1A. In this case, the stepping motor may be adjusted to reduce the number of drive pulses of the stepping motor. If base pattern Pb is recorded so that base pattern Pb overlaps line pattern Pa of first test pattern P1, the feeding amount is correct, and the feeding amount may be used for subsequent printing.

Figure 5A:
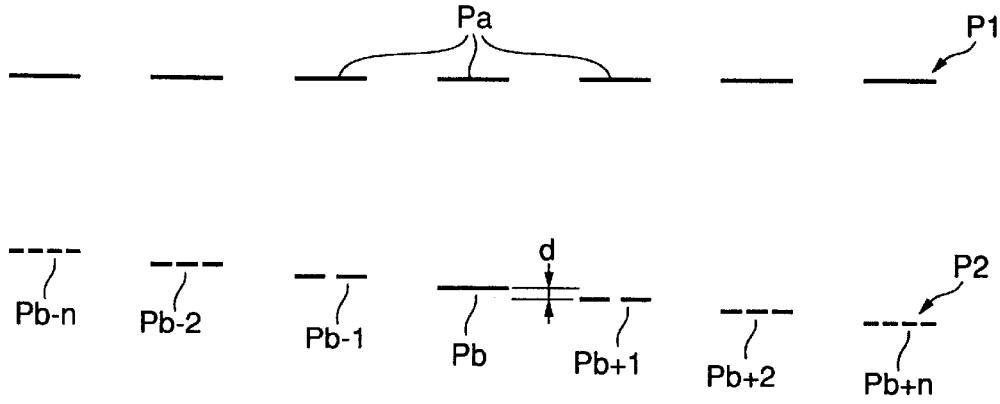
FIGS. 5A and 5B are views illustrating another example of the first and second test patterns in the first embodiment of the present invention.

In the above described embodiment, the relations between first test pattern P1 and second test pattern P2 are such that the line patterns of second test pattern P2 are recorded in regions between line patterns Pa of first test pattern P1. However, the recording patterns of second test pattern P2 may be recorded to correspond to the recording positions of first test patterns as illustrated in FIG. 5A. In this case, one recording pattern of second test pattern P2 is recorded to overlap a particular line pattern Pa of first test pattern P1.

In the above described embodiment, first test pattern P1 is first recorded, record sheet S is fed by a prescribed amount, and then second test pattern P2 is recorded. Therefore, a nozzle in the upstream is selected for base nozzle Na of recording head 8. However, second test pattern P2 may be first recorded, record sheet S may fed by a prescribed amount, and first test pattern P1 may be recorded. In this case, a nozzle in the downstream (downstream of the feeding direction of record sheet S) of recording head 8 is set as specific nozzle Na, and nozzles for second test pattern P2 which are backward and forward nozzle Nb and include nozzle Nb are set in the upstream.

Second test pattern P2 is recorded with line patterns similarly to first test pattern P1. When specifying base pattern Pb by nozzle Nb may be troublesome and lead to a mistake, however, only base pattern Pb may be recorded in dash line. As illustrated in FIG. 5A, only base pattern Pb may be a solid line and other patterns Pb−n to Pb+n may be recorded in dash lines. As an optimum pattern, patterns Pb−1 and Pb+1 adjacent to central pattern Pb are two-dash lines and patterns Pb−2 and Pb+2 are three-dash lines. By thus increasing the number of dashes in the patterns as the patterns are away from the center, it can be easily recognized that the pattern is away from the center by how many dots.

Figure 5B:
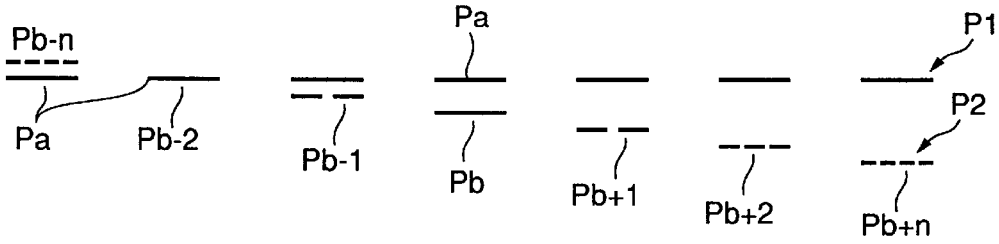

Thus, even if one pattern of second test pattern P2 overlaps one pattern Pa of first test pattern P1 as illustrated in FIG. 5B, it can be easily recognized by the shape of adjacent recorded patterns.

In the foregoing, the principle of adjusting the displacement amount by recording first and second test patterns P1 and P2 has been described. In the following, a method of actually adjusting the displacement amount will be described.

As described above, first and second test patterns P1 and P2 as illustrated in FIG. 3A are recorded, and deviation in the feeding amount of record sheet S can be easily recognized. An example of adjustment for adjusting the feeding amount according to the recognition result will be described.

Figure 6:
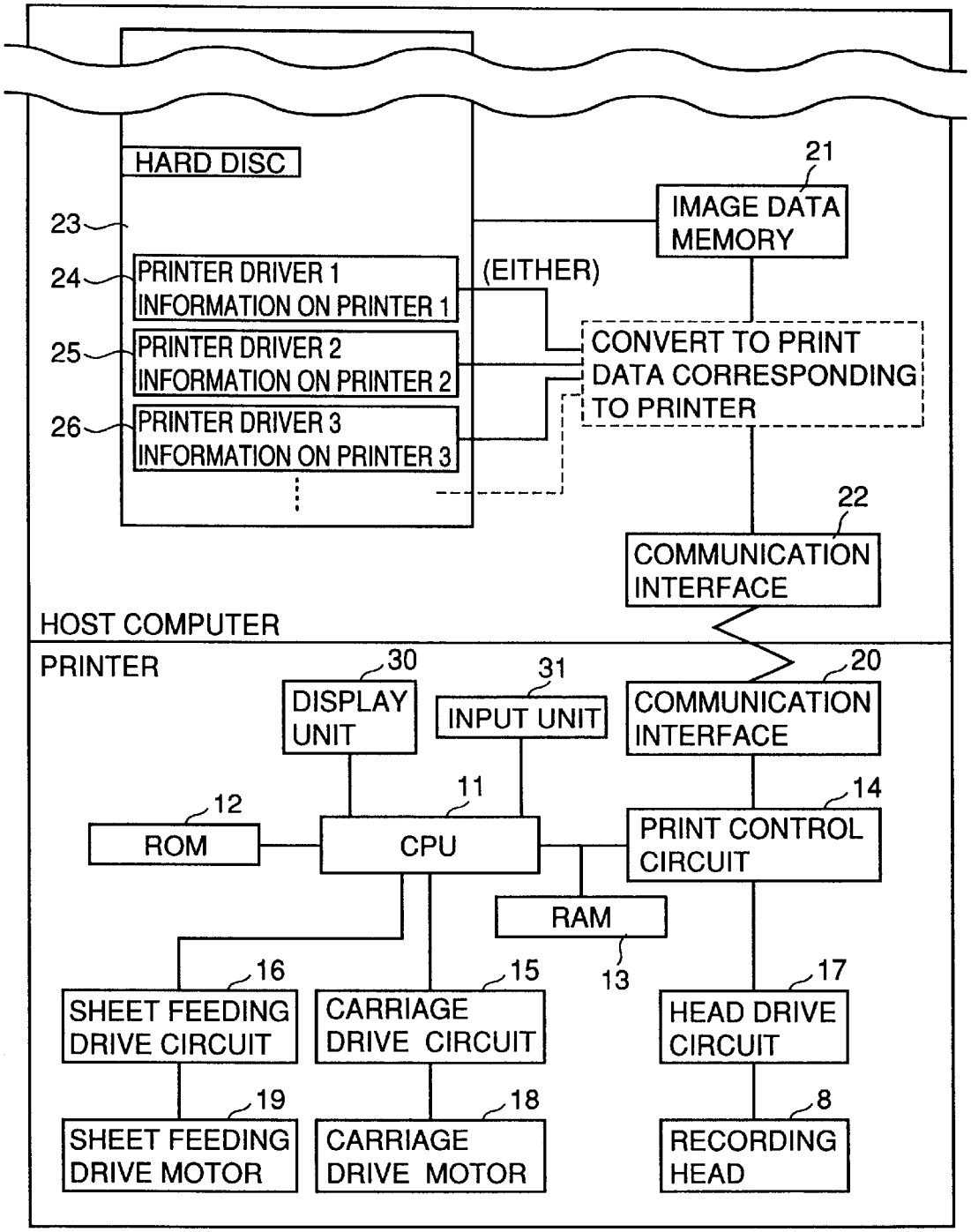
FIG. 6 is a block diagram showing a structure of a control circuit for adjusting record displacement according to the present invention.

FIG. 6 is a block diagram showing a schematic structure of an ink jet printer in the first embodiment and a host computer which is connected to the printer. The ink jet printer includes a recording head 8, a CPU (Central Processing Unit) 11 which controls the entire ink jet printer, a program ROM (Read Only Memory) 12, an RAM (Random Access Memory) 13 which is used for an work area, for example, a print control circuit 14 which controls the timing of emitting ink, for example, a head drive circuit 17 which drives recording head 8, a carriage drive motor 18, a carriage drive circuit 15 which drives carriage drive motor 18, a sheet feeding drive motor 19, a sheet feeding drive circuit 16 which drive sheet feeding drive motor 19, a communication interface 20 which carries out data communication with the host computer, a display unit 30 which displays a message and the like to a user, and an input unit through which a user inputs an instruction.

The host computer (personal computer) includes an image data memory 21 which stores image data recorded by the ink jet printer, a communication interface 22 which carries out data communication with the ink jet printer, and a hard disc 23.

In the printer illustrated in FIG. 6, CPU 11 carries out recording control according to a program stored in program ROM 12. The printer has RAM 13 which stores control information and the like for recording images. RAM 13 stores data which includes received image data and can particularly store multiple lines of data (one line data) which is recorded when recording head 8 moves once, or one page of data.

Print control circuit 14, carriage drive circuit 15, sheet feeding drive circuit 16 and the like are connected to and controlled by CPU 11. Print control circuit 14 controls ink emission from each nozzle of recording head 8, and controls the emission timing or the like according to data which is once stored in RAM 13 correspondingly to the position of recording head 8 in the main scanning direction. Recording head 8 is controlled by head drive circuit 17.

Carriage drive circuit 15 transports record sheet S to the normal position, and controls the running and driving of the carriage, which is provided with recording head 8, in the main scanning direction by a record start instruction. Carriage drive circuit 15 drives carriage drive motor 18, and runs the carriage. By the running, the position of the carriage, particularly the position of recording head 8, is recognized. According to the recognition, the ink emission timing is controlled by above described print control circuit 14, and ink is emitted to a desired position of record sheet S for recording. In recognizing the carriage position and the like, the running position is recognized by a position signal which is output from an encoder provided in carriage drive motor 18.

Further, sheet feeding drive circuit 16 receives a signal which indicates that the movement of the carriage to the end position in the main scanning direction by carriage drive circuit 15 is completed, and then controls the driving of sheet feeding drive motor 19 to feed record sheet S by a prescribed amount. In other words, the record sheet is fed by the length which corresponds to one line. For example, a pulse motor is used as sheet feeding drive motor 19 and it enables the feeding of record sheet S by a determined amount through driving in a prescribed number of steps. The number of drive steps which are input to sheet feeding drive motor 19 is controlled by CPU 11.

By sequentially carrying out the above controls, one page of an image is reproduced on record sheet S. The printer formed as shown in FIG. 2 is connected via a communication interface to a terminal such as a personal computer as the host computer. Therefore, image data which is input from the personal computer can be reproduced and output on the printer side.

The personal computer is connected to the printer via a well-known communication interface, and data on an image which is formed is temporarily stored in an image data memory 21. Such image data in image data memory 21 that are formed by carrying out editing and image processing on documents, charts, graphs, photographs and the like are transferred to the printer via communication interface 22. The personal computer transfers, together with image data, print conditions for reproducing and outputting the image data using the printer, that is, print control information and the like.

Control information for controlling the printer includes information on the feeding amount of a record sheet as described above. Besides, there are information on the recording quality (printing quality) of user-selected data, which is to be recorded, such as high quality recording, ordinary recording, draft recording, information for designating monochrome or color, information for designating concentration, information for designating recording when recording head 8 moves forth or recording when recording head 8 moves back and forth, and so on. Such information is stored in a desired region of hard disc 23 and transferred together with image data to the printer side.

Hard disc 23 has storage regions 24, 25, 26, . . . which store various information on the printer. The information stored in the storage regions is designated and selected by a user according to the display screen of the personal computer. The designated and selected printer control information is stored. The information includes the feeding control of record sheet S described above, especially the adjustment values (correction values) of the feeding amount.

The printer stores image data, which is transferred from the personal computer, in RAM 13, and CPU 11 controls image data recording for RAM 13, carriage running, the sheet feeding amount and the like based on the transferred control information stored in storage regions 24, 25, 26, . . . of hard disc 23. For example, CPU 11 controls print control circuit 14 so that recording head 8 emits ink. CPU 11 also carries out recording control by using yellow, cyan, magenta, and black recording heads 8 according to color image designation.

Figure 7:
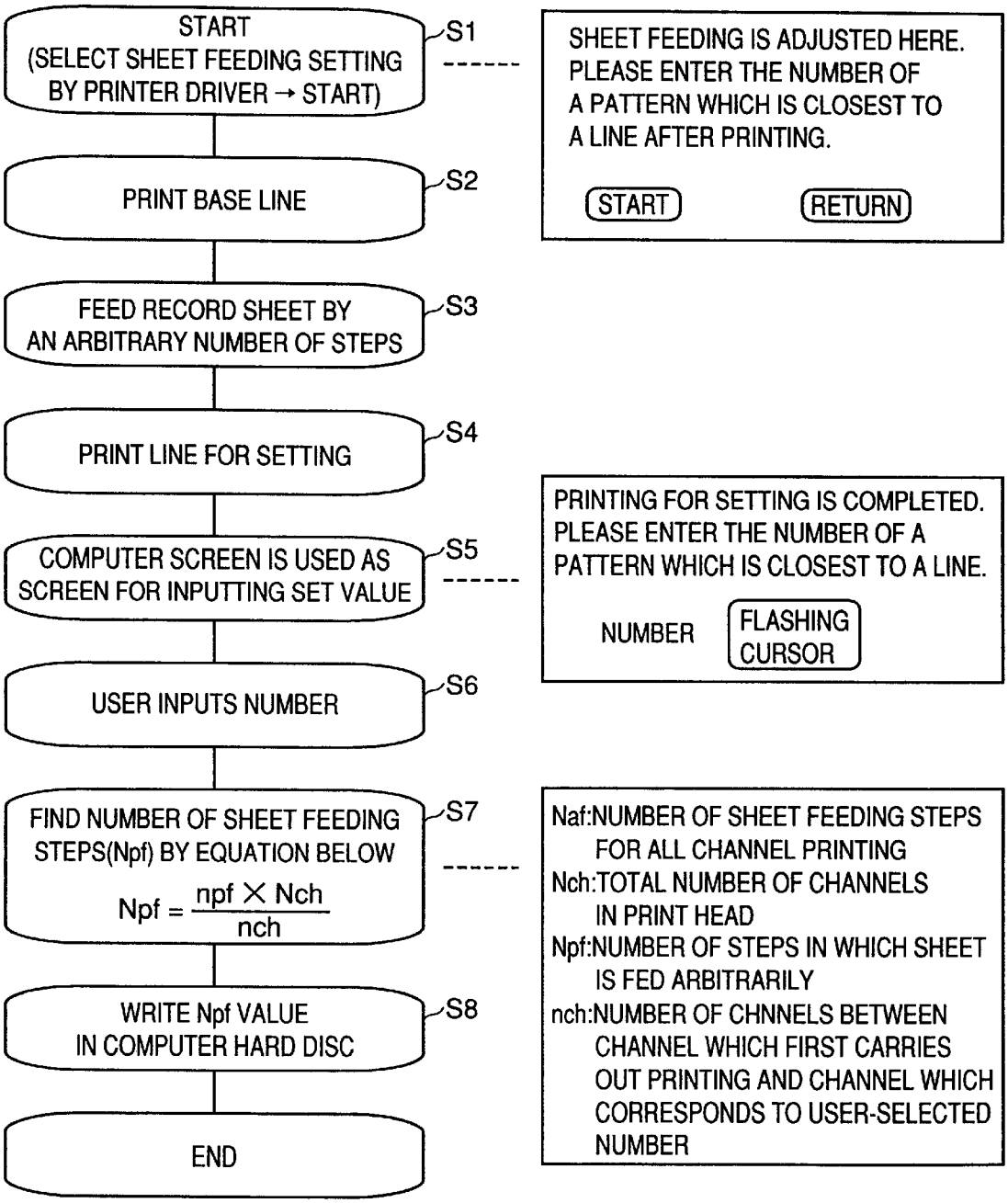
FIG. 7 is a flow chart for describing an example of the control procedure for adjustment of record displacement.

Referring to FIG. 7, the control procedure for adjusting the feeding of record sheet S according to the present invention will be described in the following.

Figure 1C:
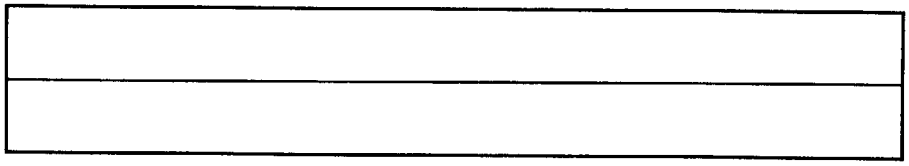
FIG. 1C PRIOR ART
FIG. 1C is a view illustrating a normal recording state, not including record displacement, with a normal feeding amount.

The adjustment control to obtain the result illustrated in FIG. 1C by adjusting the feeding of record sheet S will be described. First, first and second test patterns P1 and P2 illustrated in FIG. 3A are recorded while record sheet S is transported. In step S1, a user or a service man inputs an indication for carrying out the feeding adjustment of record sheet S through the personal computer. The indication is transferred to the printer side, and the printer enters an adjustment mode and carries out control for sending record sheet S to the recording position.

At this time, data which includes the feeding amount for adjusting record sheet S is transferred to the printer from one of storage regions 24, 25, 26, . . . of a printer driver, for example, from storage region 26. The printer feeds record sheet S to a position at which recording head 8 can record first test pattern P1. The personal computer correspondingly displays the one as illustrated in step S1 of FIG. 7. Record sheet S is transported in the printer when a user, for example, inputs a start designation (S1).

Then, first test pattern P1 is recorded (S2). After the recording of first test pattern P1 is completed, recording head 8 is returned to the home position and, at the same time, the feeding control by the feeding amount of record sheet S which has been transferred from the personal computer is carried out (S3).

Then, recording head 8 is moved to record second test pattern P2 (S4). After the recording of second test pattern P2 is completed, record sheet S is discharged onto discharging tray 10 through discharging rollers 6. The user checks test patterns P1 and P2 which have been recorded on discharged record sheet S. The personal computer displays a screen for inputting the checked state as illustrated. The display is provided when a signal indicating the end of outputting is input through communication interfaces 20 and 22 (S5). If pattern Pb−2 of second test pattern P2 has been recorded to overlap a portion between line patterns Pa of test pattern P1 as illustrated in FIG. 3B, for example, the number of the pattern is input (S6).

When the personal computer receives the pattern number, it carries out the calculation in step S7, and finds the feeding amount (adjustment or correction value) of record sheet S, which corresponds to one line, for recording by all channels. That is, the number of pulses (Npf) for sheet feeding drive motor 19 to feed record sheet S, which is transported by transporting rollers 5, by one line is found, and the found pulse number is stored in storage region 26, for example, of hard disc 23 (S8).

When the above described adjustment control is completed, the printer receives, together with image data, the feeding amount of record sheet S which is adjusted by the print designation from the personal computer, and carries out recording control accordingly. Thus, record displacement between a certain line and the next line is eliminated, and good recording is performed.

The feeding amount Npf of record sheet S in step S7 is found by multiplying the total number of channels of recording head 8, that is, the number Nch of recording nozzles N for emitting ink by the driving amount (the number of drive pulses/steps) npf of sheet feeding drive motor 19 which corresponds to the distance between base nozzle Na for recording first test pattern PI and central nozzle Nb for recording second test pattern P2, and then-dividing the multiplied value by the number of channels (nozzles) between base nozzle Na and nozzle Nb−2 which corresponds to such a pattern (Pb−2, for example) of second test pattern P2 that matches first test pattern P1.

In the foregoing, the case where the personal computer controls record sheet feeding has been described. However, the description is not limited to such a specific example. The printer may store the feeding amount of record sheet S for the above described adjustment, and carry out the feeding control of record sheet S based on the stored information.

Therefore, the printer side includes display unit 30 and input unit 31 as illustrated in FIG. 6. The transport amount of record sheet S can be adjusted so as to be able to record image data, which is externally input via communication interface 20, in the recording state as illustrated in FIG. 1C using the printer. The printer is set to an adjustment mode by input unit 31. The mode setting is carried out by operating an adjustment mode setting key, not shown, provided in input unit 31. Thus, the setting of the adjustment mode is displayed on display unit 30.

When the adjustment mode is entered, the printer feeds record sheet S through feeding roller 2 or the like and transports it to the recording position through transporting rollers 5. In this state, first test pattern P1 (or second test pattern P2) illustrated in FIG. 3A is recorded and, after the record sheet S is fed by a prescribed amount, second test pattern P2 (or first test pattern P1) is recorded. By the recording, the recording result as illustrated in FIG. 3B can be obtained.

The user checks record sheet S, on which the test patterns have been recorded and which has been discharged, to check the positional relations of the recorded pattern Pb of second test pattern P2 with each line pattern Pa of first test pattern P1. After the checking, the user inputs, through input unit 31, the position of a matched pattern, that is, indicates that pattern Pb−2 which is two patterns before base pattern Pb is matched in the state of FIG. 3B, for example. As a result, the feeding amount Npf of record sheet S which corresponds to recording of one line is found by the equation shown in step S7. The found feeding amount (adjustment value) Npf is stored in RAM 13.

If the printer is set to the print mode by input unit 31, the feeding amount of record sheet S is controlled according to the contents stored in RAM 13, which are stored by print starting. Thus, good recording illustrated in FIG. 1C can be performed.

The transport of record sheet S described above is always carried out at a constant amount by transporting rollers 5. Especially according to the structure in FIG. 2, transporting rollers 5 are provided to transport record sheet S to the recording position at which recording head 8 is moved. In transporting rollers 5 or the like, slipping, for example, is not caused by the feeding of a record sheet. After recording, however, record sheet S is transported through discharging rollers 6 for discharging.

Figure 8A:
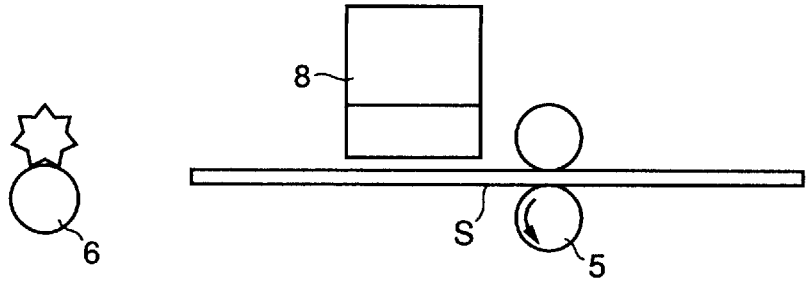
FIGS. 8A to 8D are views for describing different states when a record sheet is transported to a recording position in the first embodiment of the present invention.
Figure 8B:
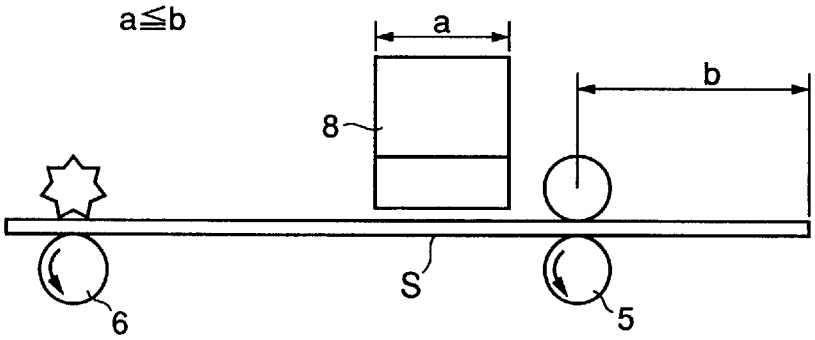
Figure 8C:
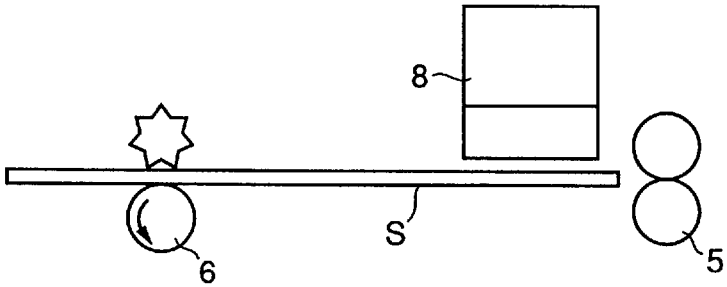
Figure 8D:
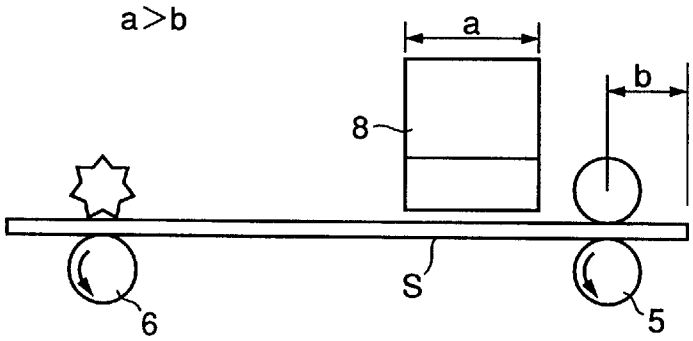

Therefore, record sheet S is transported through transporting rollers 5 to the recording position, that is, the recording position which faces recording head 8. There may be four different states of transporting and stopping record sheet S. FIG. 8A illustrates a state where record sheet S is transported only by transporting rollers 5. FIG. 8B illustrates a state where record sheet S is placed on and transported by both discharging rollers 6 and transporting rollers 5. FIG. 8C illustrates a state where the rear end of record sheet S has passed through transporting rollers 5 and record sheet S is transported only by discharging rollers 6. FIG. 8D illustrates a state where record sheet S is transported by both discharging rollers 6 and transporting rollers 5, and the distance b from the position of transporting rollers 5 which holds record sheet S to the rear end of record sheet S attains the relationship of a>b with respect to the recording width a of one line which can be recorded when recording head 8 is moved once (width of one line in the sub scanning direction).

Record sheet S is transported while it is stretched so as not to loosen at the recording position. Therefore, the transporting speed of discharging rollers 6 is set to be slightly higher than the transporting speed of transporting rollers 5. In FIGS. 8A to 8D, the upper idler roller of discharging rollers 6 is a star-shaped roller. This is intended to solve the problem of offset which is caused when ink adhered to record sheet S does not dry, the ink adheres to the roller and transfers back to record sheet S. The contact portion with the recording surface of record sheet S is thus made a point shape. When the ink is of a quick-drying type, therefore, the idler roller may be a roll shape.

The transport amount of record sheet S in the state of FIG. 8A is determined by the transporting speed of transporting rollers 5. The transport amount of record sheet S in FIG. 8C is determined by the transporting speed only of discharging rollers 6. Further, the transport amount of record sheet S in FIG. 8B is determined by the slip phenomenon of transporting rollers 5 and discharging rollers 6. In this case, the transport amount is influenced by a difference between the transporting force of discharging rollers 6 and the transporting force of the transporting rollers 5, and it is determined by the slip of either discharging rollers 6 or the transporting rollers 5. The transport by the distance of a in FIG. 8D is similar to that of FIG. 8B. Thereafter, the total transport amount is determined by the transporting speed of discharging rollers 6.

Even in the transporting states of the above described four types, the transport amount by transporting rollers 5 and the like can be adjusted. That is, the above described four type transporting states can be checked by recording first and second test patterns illustrated in FIG. 3A in each state. In this case, recording is carried out on one record sheet S in the states of FIGS. 8A to 8D. By checking the displacement amount according to the recording result and inputting the displacement amount, the feeding amount Npf of record sheet S which allows recording in the normal state illustrated in FIG. 1C can be found using the equation in step S7 of FIG. 7.

Therefore, more correct recording can be made possible by carrying out control according to the feeding amount of record sheet S in each of the four states when carrying out recording on one record sheet S.

Second Embodiment

According to the above described first embodiment, recording head 8 is moved to record one line at a time, and record displacement which is caused by deviation in the feeding amount of record sheet S is adjusted.

The above described record displacement may be adjusted, for example, when transporting rollers 5 or the like are replaced, when the printer is shipped, after recording is performed a determined number of times, or initially when the printer is powered on. At this time, a user inputs the recorded state of first and second test patterns P1 and P2, that is, the record displacement amount, and stores the transport amount of record sheet S which does not result in displacement. The transport amount is utilized when recording image data.

Besides, when color recording is performed, a plurality of recording heads have to be used for recording. That is, by providing a plurality of recording heads 8 which correspond to yellow, magenta, cyan and black on one carriage and moving the carriage, ink of a desired color is emitted on record sheet S, and thus a color image can be reproduced.

Even with recording head 8 of this type, record displacement is caused by a variation of the provided position. That is, record displacement due to a variation of the ink emission timing of recording head 8 occurs. To adjust the displacement amount, test patterns which are similar to first and second test patterns P1 and P2 described in the first embodiment of the present invention are recorded for adjustment. In a second embodiment, the displacement amount in the main scanning direction is adjusted.

Figure 9A:
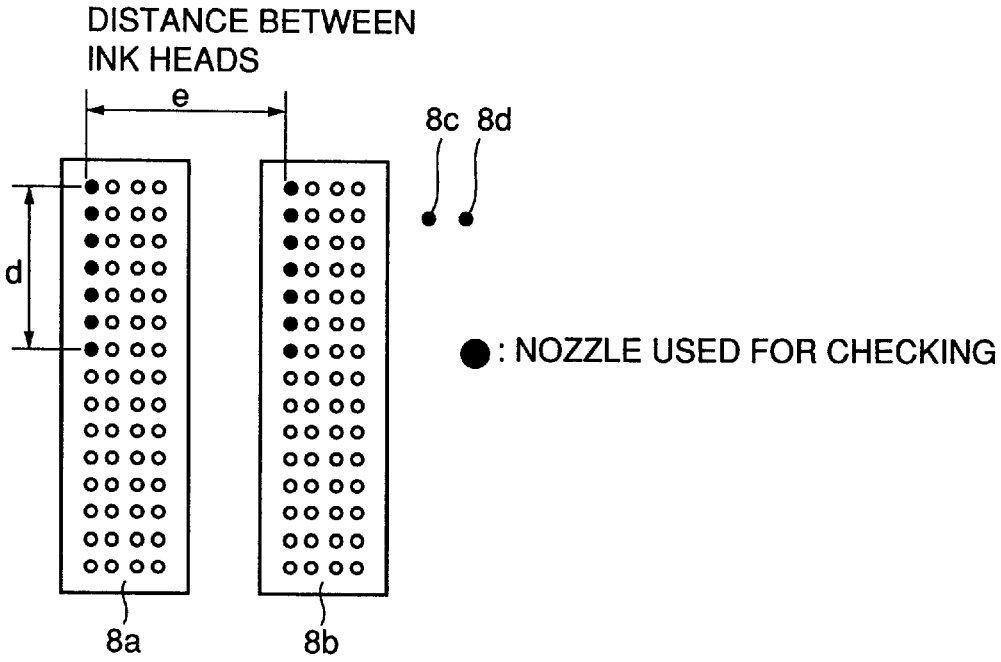
FIGS. 9A and 9B are views for describing a method of adjusting record displacement in the scanning direction caused by the recording head in the serial printer according to a second embodiment, illustrating first and second test patterns used for adjustment.

As illustrated in FIG. 9A, recording heads 8*a*, 8*b*, . . . of a plurality of different colors are provided on a carriage to form a color image.

Figure 9B:
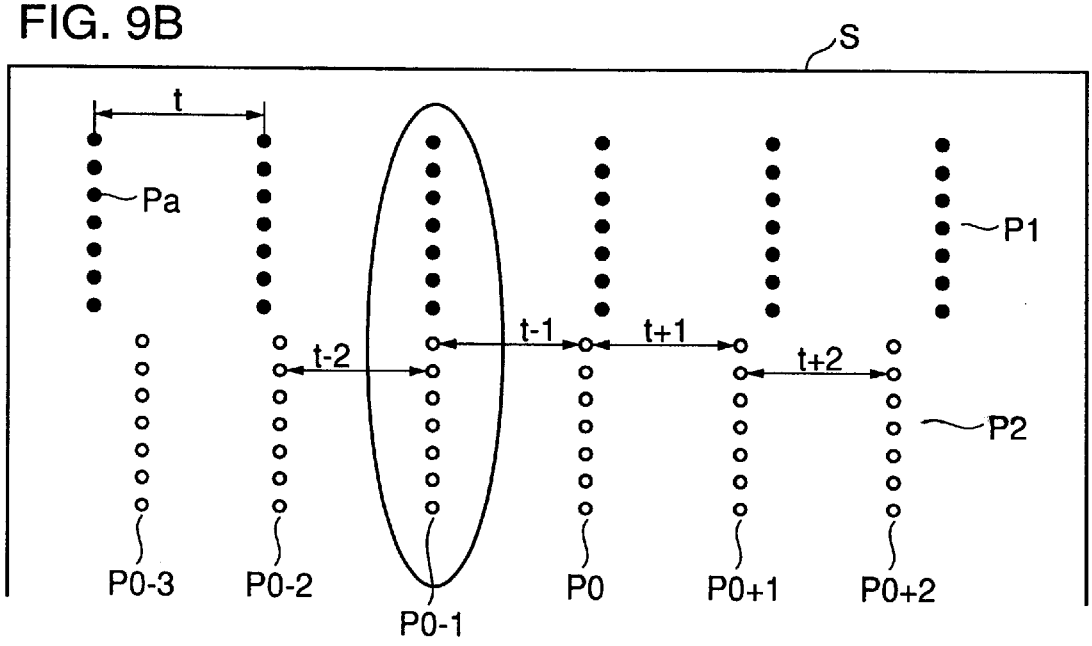

In this embodiment, recording heads 8*a*, 8*b* which are adjacently provided to check displacement in the scanning direction (main scanning direction) of recording heads 8*a*, 8*b* will be described as an example. First, first test pattern P1 is recorded on record sheet S, as illustrated in FIG. 9B, by using recording head 8*a*. First test pattern P1 is recorded by specific nozzles of recording head 8*a*, for example, the nozzles denoted by ● in FIG. 9A. In this case, when the carriage moves once, the specific nozzles of recording head 8*a* are used to emit ink at a determined time interval, that is, for every 10 μsec, for example. Thus, first test pattern P1 is recorded.

First test pattern P1 is formed by recording a plurality of vertical patterns Pa at a prescribed interval, that is, for every period t as illustrated in FIG. 9B. For example, period t is 10 μsec. Recording is started from the left side of record sheet S. First vertical pattern Pa is recorded at determined timing, and vertical patterns Pa are sequentially recorded at an interval which corresponds to 10 μsec. Thus, first test pattern Pa is recorded on record sheet S.

After first test pattern P1 is recorded, record sheet S is moved, during the operation for returning the carriage, by an amount which corresponds to the distance d between end nozzles for recording first test pattern P1 of recording head 8. Adjacent recording head 8*b* records second test pattern P2. The recording is carried out at such timing that corresponds to the recording position of first test pattern P1, and at a time interval which is smaller than that when first test pattern P1 is recorded by 1 μsec.

In recording second test pattern P2, for example, a base pattern P0 is set as a center, and recording patterns are recorded at a time interval for moving recording head 8*b* different from that when first test pattern P1 is recorded. In recording base pattern P0, considering the ink head interval e between adjacent recording heads 8*a* and 8*b* as illustrated in FIG. 9A, base pattern P0 is recorded at normal timing which corresponds to vertical pattern Pa of first test pattern P1 in the feeding direction of a record sheet. Recording patterns P0−1 and P0+1 are recorded by moving recording head 8*b* for a time period of t−1. When t=10 μsec, for example, recording is carried out at a time interval as small as 9 μsec. Further, P0−2 and P0+2 are recorded at recording timing which is 1 μsec smaller than recording patterns P0−1 and P0+1.

If base pattern P0 of second test pattern P2 is recorded at normal recording timing without displacement, base pattern P0 linearly links to one vertical pattern Pa of first test pattern P1 in the sub scanning direction (the feeding direction of a record sheet). In the recording result illustrated in FIG. 9B, however, recording pattern P0−1 of second test pattern P2 links to one vertical pattern Pa of first test pattern P1. Therefore, by delaying only the recording timing of recording head 8*b* by 1 μsec for emission and, thereafter, causing control at determined timing, record displacement in the main scanning direction can be eliminated by using a plurality of heads.

In this case, second test pattern P2 may be first recorded before recording first test pattern P1. In the description of FIGS. 9A and 9B, displacement is adjusted by a pair of adjacent recording heads 8*a* and 8*b*. However, first and second test patterns P1 and P2 can of course be adjusted similarly by other recording heads 8*c* and 8*d*, and so on.

The above described second embodiment covers only the adjustment of displacement between recording heads especially when recording is carried out only by moving (moving forth) recording head in one direction. However, recording by recording head 8 is possible not only when it moves in one direction, that is, moves forth but when it moves back. By thus carrying out recording when the recording head moves back and forth, the recording speed can be approximately doubled.

Figure 10:
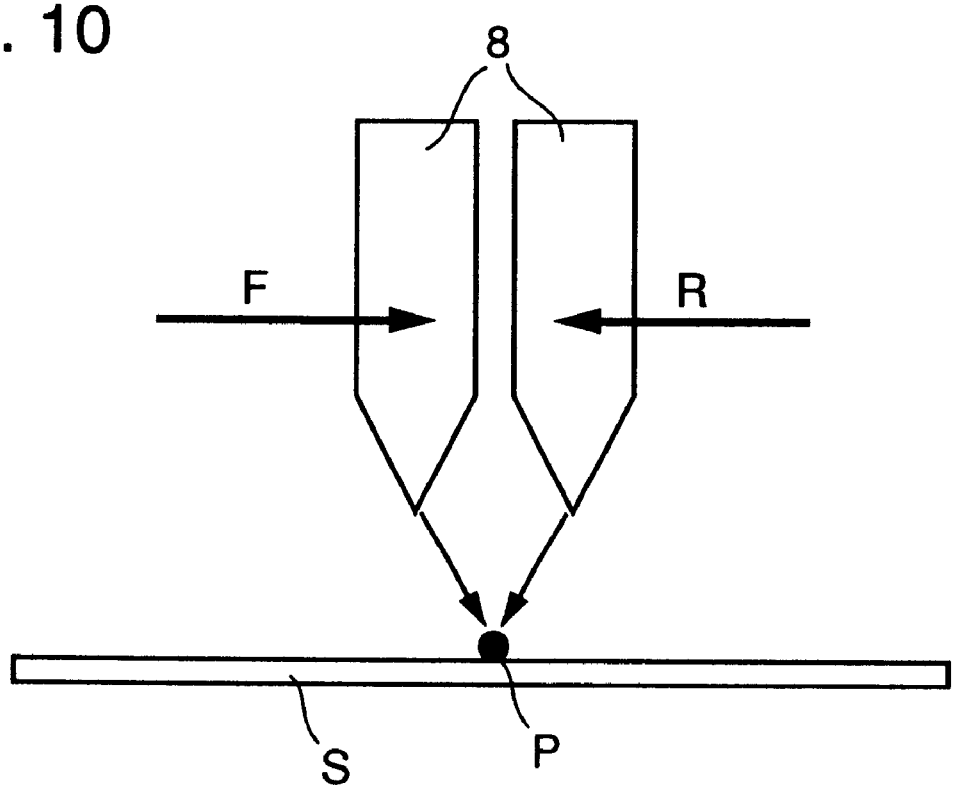
FIG. 10 is a view for describing the state of record displacement when recording is carried out by moving back and forth the recording head in the second embodiment of the present invention.

When recording is carried out by moving recording head 8 back and forth, the position of record sheet S at which emitted ink droplets arrive is different in a serial printer, especially, an ink jet printer between when the head moves forth and when the head moves back. As illustrated in FIG. 10, the timing of ink droplet emission on the same point, that is, the position of recording head 8 when it emits ink is different between the case when recording head 8 moves forth (in the direction of arrow F) and the case when recording head 8 moves back (in the direction of arrow R). This is because when recording head 8 moves, emitted ink droplets come to have a speed vector in the direction of movement of recording head 8. As a result, when recording is carried out by moving the head back and forth as illustrated in FIG. 10, the emission timing for causing ink droplets to reach and adhere to the same point p, that is, the position of recording head 8 when it emits ink, or the like has to be adjusted.

Conventionally, the timing setting illustrated in FIG. 10 is performed in advance when recording is carried out by moving the head back and forth. However, deviation with the passage of time, change in the ink viscosity, replacement of recording head 8, and the like may cause timing deviation. By recording first and second test patterns P1 and P2 described in the second embodiment to adjust record displacement, the timing can be adjusted easily.

In the following, the adjustment of record displacement when recording is carried out while recording head 8 moves back and forth will be described. When record sheet S stops at the recording position, recording head 8 is moved forth in this state to record first test pattern P1 at determined timing, that is, for every prescribed time t. The record is as illustrated in FIG. 9B. Then, recording head 8 is temporarily stopped to feed record sheet S by a prescribed amount and stop the sheet. The feeding by a prescribed amount is as described above, and it is an amount which corresponds to the recording width when one pattern of first test pattern P1 is recorded by recording head 8.

When the feeding of record sheet S by a prescribed amount is completed, record sheet S is stopped and recording head 8 is moved back. At this time, ink emission is performed at a time interval which is smaller than when first test pattern P1 is recorded by 1 μsec, on the basis of predetermined emission timing, for example to record second test pattern P2 as illustrated in FIG. 9B. If base pattern P0 linearly links to one vertical pattern Pa of first test pattern P1 in the feeding direction of the record sheet at this time, the emission timing when the head moves back may be as predetermined.

If one pattern P0−1 of the second test pattern linearly links to one vertical pattern Pa of first test pattern P1 as illustrated in FIG. 9B, the emission start timing when the head moves back is made earlier by 1 μsec and, thereafter, emission is performed at determined timing. Thus, good recording is performed without displacement in recording when the head moves back and forth.

Even in the second embodiment, a user can make easy adjustment. When a personal computer is used in the structure of the control circuit illustrated in FIG. 6, a selection is made to perform the adjustment of record displacement caused by deviation in the ink emission timing in the main scanning direction of recording head 8 or the adjustment of deviation in the feeding amount of record sheet S, and then the printer is entered to one of the adjustment modes. When the ink emission timing is adjusted according to the adjustment mode, data which includes the ink emission timing of recording head 8 is sent to the printer from drivers 24, 25, 26, . . . of hard disc 23 in the personal computer which store printer information.

The printer transports record sheet S to the recording position, records first test pattern P1 as illustrated in FIG. 9B at prescribed timing, feeds record sheet S by a prescribed amount, and records second test pattern P2 at determined timing. When a user checks the recorded record sheet S and inputs the timing information, desirable printer information is stored in one of storage regions 24, 25, . . . for subsequent recording control.

For adjustment in the printer, selection and designation of an adjustment mode by input unit 31 as described above cause display unit 31 to display the contents corresponding to the adjustment mode. When the user checks the recording result of first and second recorded test patterns P1 and P2 and inputs a timing adjustment value through input unit 31, the recording timing after adjustment is stored in RAM 13 and is utilized for subsequent recording control.

As described above, according to the present invention, deviation in the recording timing of a recording head in the main scanning direction and displacement of a record sheet in the feeding direction can be adjusted in a serial printer which carries out recording for each one line using a multi-channel recording head and recording is carried out by feeding a record sheet by an amount which corresponds to the amount of one line. First and second test patterns P1 and P2 are recorded on a record sheet and can be easily checked by a user Based on the checked result, the adjustment of the recording timing of the recording head or the adjustment of the feeding amount of a record sheet is performed.

The first and second test patterns are formed of a combination of simple patterns. The displacement amount can be easily recognized by the first and second test patterns. Since second test pattern P2 is recorded to be offset from a normal base pattern (Pb or P0) by a prescribed amount, the displacement amount from the base pattern can be recognized easily and can be easily adjusted by the recognition result.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of adjusting record displacement of a serial printer including a recording head recording a plurality of lines at a time in a main scanning direction, comprising the steps of:

recording, in the main scanning direction, a first test pattern formed of a plurality of line patterns spaced apart by a prescribed distance;

feeding a record sheet by a prescribed amount;

recording a second test pattern, wherein said step of recording said second test pattern includes the step of recording a plurality of line patterns which are recorded, in the main scanning direction, between the plurality of line patterns in said first test pattern and which are recorded at positions offset from one another in a feeding direction; and adjusting a feeding amount of said record sheet based on positional relations between said first test pattern and said second test pattern.

2. The method of adjusting record displacement of a serial printer according to claim 1, wherein a plurality of line patterns included in said second test pattern include a feature which distinguishes them from other line patterns recorded in said second test pattern.

3. The method of adjusting record displacement of a serial printer according to claim 1, wherein said line patterns included in said second test pattern are each recorded to be offset by one dot in the feeding direction.

4. The method of adjusting record displacement of a serial printer according to claim 1, wherein said step of feeding said record sheet by a prescribed amount includes the step of feeding said record sheet by changing the feeding amount according to a feeding state of said record sheet.

5. A method of adjusting record displacement of a serial printer including a recording head recording a plurality of lines at a time in a main scanning direction, comprising the steps of:

recording, in the main scanning direction, a first test pattern formed of a plurality of line patterns spaced apart by a prescribed distance;

feeding a record sheet by a prescribed amount;

recording a second test pattern; and adjusting a feeding amount of said record sheet based on positional relations between said first test pattern and said second test pattern, wherein said step of recording said second test pattern includes the step of recording a plurality of line patterns which are recorded at the same positions in the main scanning direction as the plurality of line patterns in said first test pattern, and which are recorded at positions offset from one another in the feeding direction.

6. The method of adjusting record displacement of a serial printer according to claim 5, wherein a plurality of line patterns included in said second test pattern include a feature which distinguishes them from other line patterns recorded in said second test pattern.

7. The method of adjusting record displacement of a serial printer according to claim 5, wherein said line patterns included in said second test pattern are each recorded to be offset by one dot in the feeding direction.

8. A serial printer, comprising:

a recording head recording a plurality of lines at a time in a main scanning direction;

a first drive-unit driving said recording head;

a second drive unit transporting a record sheet;

a first control unit controlling said first drive unit to cause said recording head to record, in the main scanning direction, a first test pattern formed of a plurality of line patterns spaced apart by a prescribed distance, controlling said second drive unit to feed said record sheet by a prescribed amount, and controlling said first drive unit to cause said recording head to record a second test pattern formed of prescribed recording patterns; and a second control unit controlling said second drive unit to transport said record sheet according to a feeding amount determined based on positional relations between said first test pattern and said second test pattern, wherein said second test pattern includes a plurality of line patterns which are recorded, in the main scanning direction, between the plurality of line patterns in said first test pattern and which are recorded at positions offset from one another in the feeding direction.

9. A serial printer, comprising:

a recording head recording a plurality of lines at a time in a main scanning direction;

a first drive unit driving said recording head;

a second drive unit transporting a record sheet;

a first control unit controlling said first drive unit to cause said recording head to record, in the main scanning direction, a first test pattern formed of a plurality of line patterns spaced apart by a prescribed distance, controlling said second drive unit to feed said record sheet by a prescribed amount, and controlling said first drive unit to cause said recording head to record a second test pattern formed of prescribed recording patterns; and a second control unit controlling said second drive unit to transport said record sheet according to a feeding amount determined based on positional relations between said first test pattern and said second test pattern, wherein said second test pattern includes a plurality of line patterns which are recorded at the same positions in the main scanning direction as the plurality of line patterns in said first test pattern and which are recorded at positions offset from one another in the feeding direction.

* * * * *